US006880446B2

(12) United States Patent
Akita

(10) Patent No.: US 6,880,446 B2
(45) Date of Patent: Apr. 19, 2005

(54) AIR CUSHION CYLINDER APPARATUS WITH A LOCK

(75) Inventor: Takafumi Akita, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 10/421,704

(22) Filed: Apr. 24, 2003

(65) Prior Publication Data

US 2003/0213360 A1 Nov. 20, 2003

(30) Foreign Application Priority Data

May 17, 2002 (JP) ..... 2002-143576

(51) Int. Cl.[7] ..... F15B 15/26
(52) U.S. Cl. ..... 91/44; 91/45; 91/406
(58) Field of Search ..... 91/41, 43, 44, 91/45, 405, 406, 409; 92/24

(56) References Cited

U.S. PATENT DOCUMENTS 3,359,862 A * 12/1967 Modrich ..... 91/44
3,707,629 A * 12/1972 Colston ..... 91/45
4,214,795 A * 7/1980 Kakuminato ..... 91/41
6,308,613 B1 * 10/2001 Takahashi ..... 92/18
6,612,221 B1 * 9/2003 Rollgllgårdh ..... 92/23

* cited by examiner

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

A lock mechanism of a cylinder includes a lock member for locking or unlocking a piston rod by actions of air pressure and a spring force, a third pressure chamber for causing air pressure to act on the lock member, and a third port. In a pneumatic circuit, a check valve and a throttle valve are connected in parallel in each of first and second pipes connecting first and second ports of the cylinder and a solenoid valve and a check valve and a throttle valve are connected in parallel in a third pipe connecting the third port and the first pipe or the second pipe.

11 Claims, 6 Drawing Sheets

AIR CUSHION CYLINDER APPARATUS WITH A LOCK

TECHNICAL FIELD

The present invention relates to an air cushion cylinder apparatus with a lock including a cylinder having air cushion mechanisms and a lock mechanism and a pneumatic circuit for supplying and discharging compressed air to and from the cylinder.

PRIOR ART

FIGS. 6 and 7 conceptually show a prior-art air cushion cylinder apparatus with a lock.

The cylinder apparatus with a lock and shown in FIG. 6 includes a cylinder 102 and a pneumatic circuit 105 for supplying compressed air to the cylinder 102. The cylinder 102 has first and second pressure chambers 111 and 112 partitioned by a piston 103, first and second ports 122 for supplying compressed air to the pressure chambers, an air cushion mechanism 109 on a head side of the cylinder, and a lock mechanism 106 on a rod side of the cylinder.

In the air cushion mechanism 109, a cushion member 161 provided to the piston 103 is fitted into a cushion packing 162 in the cylinder 102 in front of a stroke end to thereby closing a discharge passage for compressed air in the first pressure chamber 111. By restrictively discharging the compressed air through a throttle valve 163, a speed reducing force is exerted with piston back pressure. A check valve 164 is disposed in parallel with the throttle valve 163.

In the lock mechanism 106, a lock ring 107 fitted over a piston rod 104 is displaced to an unlocked portion when compressed air is supplied from a third port 125 to a third pressure chamber 113. When the compressed air in the third pressure chamber 113 is discharged, the lock ring 107 is inclined by a spring force of a brake spring 108 to be engaged with the piston rod 104 to lock the piston rod.

In the pneumatic circuit 105 connected to the cylinder 102, speed controllers 131 are provided respectively in pipes 141,142 connecting the ports 121,122 and a three-position pressure center solenoid valve 157, a pressure reducing valve 159 having a check valve and for adjusting supplied pressure is provided to the pipe 141 on a side of the air cushion mechanism 109, the third port 125 of the third pressure chamber 113 is connected to a two-position solenoid valve 158 through a pipe 145, and the three-position pressure center solenoid valve 157 and the two-position solenoid valve 158 are connected to an air pressure source 155 through a pipe 146 having a pressure reducing valve 156.

Each the speed controller 131 is formed by connecting a check valve 135 and a variable throttle valve 136 in parallel and controls an operating speed of the cylinder apparatus.

In this cylinder apparatus, the cylinder can be stopped at an intermediate position, but two solenoid valves in total, i.e., the solenoid valve 158 for unlocking and the three-position pressure center solenoid valve 157 for balancing the cylinder when the cylinder stops are required. Moreover, the pressure reducing valve 159 having the check valve is also required. Therefore, the pneumatic circuit 105 for supplying compressed air to the cylinder 102 becomes complicated and the number of parts is large, which results in high cost.

However, if it is unnecessary to stop at the intermediate position in a cylinder apparatus with a one-way lock, a circuit structure can be simplified as compared with an example in FIG. 6 by connecting a third port 125 and a pipe 141 on a side of a first port 121 as shown in FIG. 7.

A cylinder apparatus 101 shown in FIG. 7 includes a cylinder 102 and a pneumatic circuit 105 for supplying compressed air. The cylinder 102 is provided with first and second pressure chambers 111 and 112 partitioned by a piston 103 and first and second ports 121 and 122 for supplying compressed air to the pressure chambers. Air cushion mechanisms 110 are respectively provided on a head side and a rod side and a lock mechanism 106 is provided on the rod side. A structure of the lock mechanism 106 is not different from that in FIG. 6.

In the air cushion mechanism 110, the ports 121,122 of the cylinder 102 are opened at cushion operation starting positions at short distances from stroke ends, exhaust holes 123, 124 for exhausting cushioning air are respectively provided at the stroke ends, and speed controllers 132 each formed by connecting a check valve 137 and a variable throttle valve 138 in parallel are respectively provided between the exhaust holes and the respective ports 121,122. Piston packings 103*a*,103*b* are respectively provided to an outer peripheral face of the piston 103 so as to occupy positions where the pieces of packing do not pass openings of the ports 121,122 and positions where the pieces of packing pass the openings but do not pass the exhaust holes 123,124 when the piston 103 reaches the stroke ends.

In the pneumatic circuit 105, speed controllers 131 are respectively connected in pipes 141,142 connecting the ports 121,122 and a two-position solenoid valve 151. The third port 125 for supplying compressed air to a third pressure chamber 113 is connected to a position of the pipe 141 on the port 121 side of the speed controllers 131 through a pipe 145. The two-position solenoid valve 151 is connected by a pipe 146 to an air pressure source 155 through a pressure reducing valve 156.

In this cylinder apparatus, when the compressed air is supplied to the first pressure chamber 111 to actuate the piston 103 forward (toward the rod side), the compressed air is also supplied to the third pressure chamber 113 through the pipe 145 and the lock is released. On the other hand, when the compressed air is supplied to the second pressure chamber 122 and the compressed air is discharged from the first pressure chamber 111 simultaneously to actuate the piston 103 rearward (toward the head side), reduction of pressure in the third pressure chamber 113 is delayed by back pressure of the first pressure chamber 111. Therefore, the lock is kept released during actuation of the piston 103.

Then, when the piston 103 reaches the stroke end, pressures in the first pressure chamber 111 and the third pressure chamber 113 are reduced and a piston rod 104 is locked.

Therefore, though the piston 103 cannot be stopped at the intermediate position, only one two-position solenoid valve is required. As a result, the structure of the pneumatic circuit 105 is simpler than that in FIG. 6.

However, if the piston 103 approaches the stroke end and the piston packing 103*a* gets over the exhaust-side port 121 into a cushioning stroke, the compressed air in the first pressure chamber 111 is gradually discharged to the pipe 141 only from the exhaust hole 123 through the speed controller 132. Because pressure in the third pressure chamber 113 sharply reduces as the compressed air is discharged, a lock ring 107 and the piston rod 104 come in contact with each other to cause stick slip and vibration or the lock ring 107 and the piston rod 104 rub against each other. Therefore, adjustments for avoiding these problems are required.

The same goes for a case in which the air cushion mechanism 110 has the structure shown in FIG. 6.

DISCLOSURE OF THE INVENTION

It is a technical object of the present invention to provide an air cushion cylinder apparatus with a lock and in which stick slip and vibration do not occur and a lock ring and a piston rod mounted in the apparatus are not worn out in spite of a simple pneumatic circuit with the small number of parts.

To achieve the above objects, according to the invention, there is provided a cylinder apparatus comprising a cylinder and a pneumatic circuit for supplying compressed air to the cylinder.

The cylinder includes a piston, a piston rod, first and second pressure chambers on opposite sides of the piston, first and second ports for supplying compressed air to the pressure chambers, an air cushion mechanism for restricting a flow rate of exhaust discharged from the respective pressure chambers to thereby stop the piston at stroke ends in a cushioned manner, and a lock mechanism for locking the piston rod at a stop position.

The lock mechanism has a lock member for operating by an action of air pressure, a third pressure chamber for causing air pressure to act on the lock member, and a third port for supplying compressed air to the third pressure chamber and is formed such that the lock member unlocks the piston rod when compressed air is supplied into the third pressure chamber from the third port and that the lock member locks the piston rod when compressed air lock ring 107 in the third pressure chamber is discharged from the third port.

The pneumatic circuit includes a solenoid valve for opening and closing a flow path connecting the cylinder and a compressed air source, speed controllers each formed by connecting a check valve and a throttle valve in parallel are respectively provided in first and second pipes connecting the solenoid valve, the first and second ports, and a driving solenoid valve, and a speed controller formed by connecting a check valve and a throttle valve in parallel is connected in a third pipe connecting the third port and the first pipe or the second pipe.

In the cylinder apparatus having the above structure, the speed controller formed by connecting the check valve and the throttle valve in parallel is connected in the third pipe connecting the third port and the first pipe or the second pipe. Therefore, if the piston approaches the stroke end and the air cushion mechanism is actuated, a rapid reduction in pressure in the third pressure chamber is prevented by an action of the throttle valve to thereby maintain an unlocked state.

Therefore, though the apparatus has the simple pneumatic circuit with the small number of parts, stick slip and vibration do not occur and a lock ring and a piston rod mounted in the apparatus are not worn out.

According to a concrete embodiment of the invention, the lock member is in a ring shape, disposed movably between an inclined position for locking the piston rod and a non-inclined position for unlocking the piston rod while being fitted over the piston rod in the third pressure chamber, and pressed in an inclined direction by a lock spring.

The throttle valve in the third pipe may be a fixed throttle valve or a variable throttle valve.

In the invention, a buffer tank for adjusting a pressure variation in the third pressure chamber is preferably provided at a position between the speed controller and the third port in the third pipe.

The buffer tank is connected in series in the third pipe or connected to a fourth pipe branching from the third pipe through a throttle valve.

In the invention, one or more of the check valves, the throttle valves, and the buffer tank may be mounted in the cylinder.

DETAILED DESCRIPTION

Figure 1:
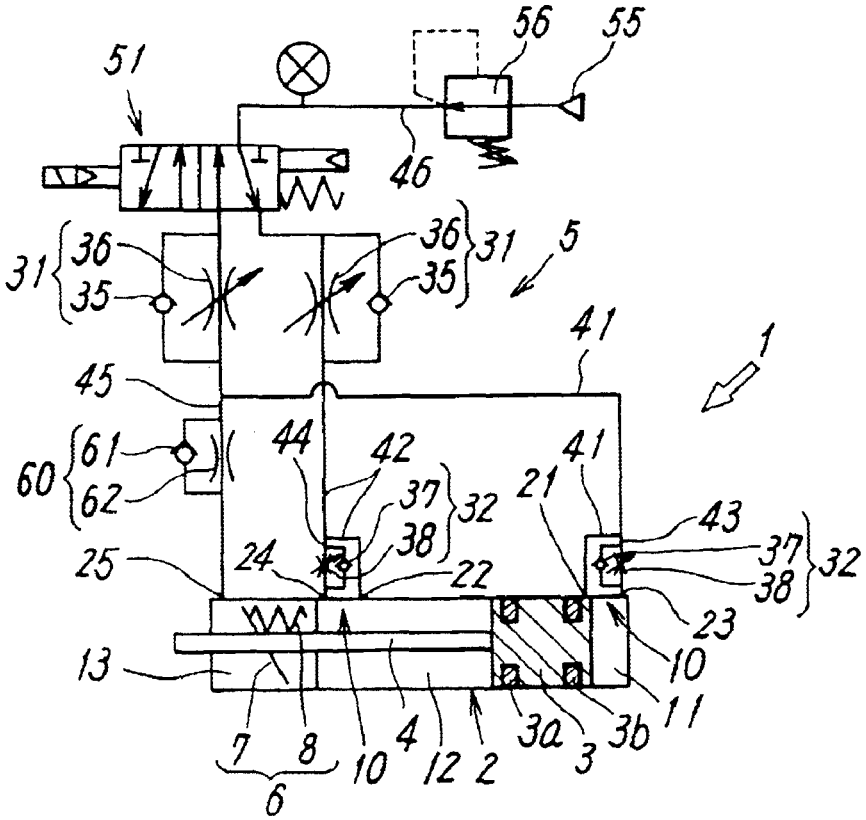
FIG. 1 is a block diagram conceptually showing an embodiment of an air cushion cylinder apparatus with a lock according to the present invention by using symbols.

FIG. 1 conceptually shows a first embodiment of an air cushion cylinder apparatus with a lock according to the present invention. In the cylinder apparatus 1 of the first embodiment, a piston rod is locked so as not to move forward at a rear end (hereafter referred to as "a forward lock").

The cylinder apparatus 1 includes a cylinder 2 and a pneumatic circuit 5 for supplying compressed air to the cylinder 2. The cylinder 2 has a head-side first pressure chamber 11 and a rod-side second pressure chamber 12 partitioned by a piston 3, a first port 21 and a second port 22 for supplying compressed air to the pressure chambers 11,12, air cushion mechanisms 10 for stopping the piston 3 respectively at both front and rear stroke ends in a cushioned manner, and a lock mechanism 6 provided on a rod side of the cylinder 2. A reference numeral 4 designates a piston rod extending from the piston.

The air cushion mechanisms 10 have exhaust holes 23,24 for exhausting cushioning air from the pressure chambers 11 and 12 at positions on stroke end sides of the first port 21 and the second port 22 of the cylinder 2. Between the exhaust holes 23,24 and pipes 41,42 connected to the ports 21,22, speed controllers 32 each formed by connecting a check valve 37 and a variable throttle valve 38 in parallel are connected. Piston packing 3*a*,3*b* are respectively provided to such positions of an outer peripheral face of the piston 3 that the pieces of packing do not pass openings of the ports 21,22 and to such positions that the pieces of packing pass the openings but do not pass the exhaust holes 23,24 when the piston 3 reaches the stroke ends. A position at the stroke end of the piston where the piston packing 3*a* or 3*b* passes the opening of the port 21 or 22 is a position where a cushioning operation starts. Therefore, openings of the ports 21,22 are provided at such positions.

Although the speed controllers 32 may be mounted in the cylinder 2, the speed controllers 32 may be connected to outside pipes 43,44 connected to the exhaust holes 23,24.

The lock mechanism 6 has a lock member 7 for operating by an action of air pressure, a third pressure chamber 13 for causing air pressure to act on the lock member 7, and a third port 25 for supplying compressed air to the third pressure chamber 13. The lock member 7 is in a ring shape, and disposed in the third pressure chamber 13 while being fitted over the piston rod 4, can be displaced between an inclined position for locking the piston rod 4 and a non-inclined position for unlocking the piston rod 4, and is pressed in an inclined direction by a lock spring 8 disposed on a face opposite to the third pressure chamber 13.

Therefore, when the compressed air is not supplied from the third port 25 into the third pressure chamber 13, the lock member 7 is pushed by the lock spring 8 to occupy the inclined position and a hole edge of a center hole of the lock member 7 is locked to the piston rod 4 to lock the piston rod at the stop position. Then, if the compressed air is supplied from the third port 25 into the third pressure chamber 13, the lock member 7 is displaced against the lock spring 8 to occupy the non-inclined position substantially perpendicular to the piston rod 4 to unlock the piston rod 4.

The pneumatic circuit 5 has an air pressure source 55 and a two-position solenoid valve 51 for selecting a flow path connecting the air pressure source 55 and the cylinder 2. In the first pipe 41 and the second pipe 42 connecting the solenoid valve 51 and the first port 21 and the second port 22, speed controllers 31 each formed by connecting a check valve 35 and a throttle valve 36 in parallel are connected. In a third pipe 45 connecting the third port 25 and the first pipe 41 at a position on a first port 21 side of the speed controller 31, a speed controller 60 formed by connecting a check valve 61 and a throttle valve 62 in parallel is connected. Furthermore, a pressure reducing valve 56 is connected in a pipe 46 connecting the solenoid valve 51 and the air pressure source 55.

The check valve 35 of each of the speed controller 31 is for intercepting a flow of air from the first port 21 toward the solenoid valve 51 and the check valve 61 of the speed controller 60 is for intercepting a flow of air from the third port 25 toward the first pipe 41. The throttle valve 36 of each the speed controller 31 is a variable throttle valve in which a flow rate can be adjusted and the throttle valve 62 of the speed controller 60 is a fixed throttle valve in which a flow rate cannot be adjusted.

In the cylinder apparatus 1 having the above structure, if the solenoid valve 51 is switched from a position opposite to a position shown in the drawing to supply the compressed air to the first pressure chamber 11 by the first pipe 41 through the speed controller 31, the compressed air is also supplied to the third pressure chamber 13 through the check valve 61 in the third pipe 45. Therefore, the piston rod 4 is unlocked, the piston 3 moves forward toward the rod side, and the compressed air in the second pressure chamber 12 is discharged into the atmosphere by the second pipe 42 through the throttle valve 36 and the solenoid valve 51.

If the solenoid valve 51 is switched to the position shown in the drawing and the compressed air is supplied to the second pressure chamber 12 through the second pipe 42, air in the first pressure chamber 11 is discharged into the atmosphere by the first pipe 41 through the throttle valve 36 and the solenoid valve 51. At this time, air in the third pressure chamber 13 also flows into the first pipe 41 through the throttle valve 62 in the third pipe 45. However, because exhausting pressure in the pressure chamber 11 does not reduce rapidly due to existence of the throttle valve 36, the exhaust pressure acts on the third pipe 45 as back pressure and a pressure reduction in the third pressure chamber 13 is suppressed. As a result, the piston rod 4 is kept unlocked and the piston 3 moves rearward toward the head side.

When the piston 3 approaches the stroke end and the piston packing 3*b* also functioning as cushion packing gets over the opening of the exhaust-side port 21, the port 21 and the first pressure chamber 11 are disconnected from each other. Therefore, the compressed air in the first pressure chamber 11 flows out restrictively only from the exhaust hole 23 through the throttle valve 38 of the speed controller 32. As a result, an air cushioning function works and pressure in the first pipe 41 starts to reduce.

However, because the third pressure chamber 13 is connected to the first pipe 41 through the check valve 61 and the throttle valve 62 connected in parallel in the third pipe 45, even if the pressure in the first pipe 41 starts to reduce as described above, the check valve 61 intercepts a flow of exhaust and exhaust in the third pressure chamber 13 flows out into the first pipe 41 little by little through the throttle valve 62. As a result, the pressure in the third pressure chamber 13 does not reduce rapidly and the lock member 7 is maintained at the non-inclined position for releasing the lock.

When the piston 3 reaches the stroke end while receiving an air cushioning action, air in the third pressure chamber 13 flows out through the throttle valve 62 and the pressure in the third pressure chamber 13 reduces. Therefore, the lock member 7 is displaced to the inclined position to lock the piston rod 4.

During the forward stroke of the piston 3, a cushioning action similar to that in the rearward stroke described above works.

As described above, in the cylinder apparatus 1, because the pressure in the third pressure chamber 13 does not reduce rapidly when the piston rod 4 approaches the stroke end and the air cushioning function is actuated, stick slip and a vibration due to contact of the lock member 7 and the piston rod 4 with each other and wearing away of the lock ring and the piston rod do not occur.

Figure 7:
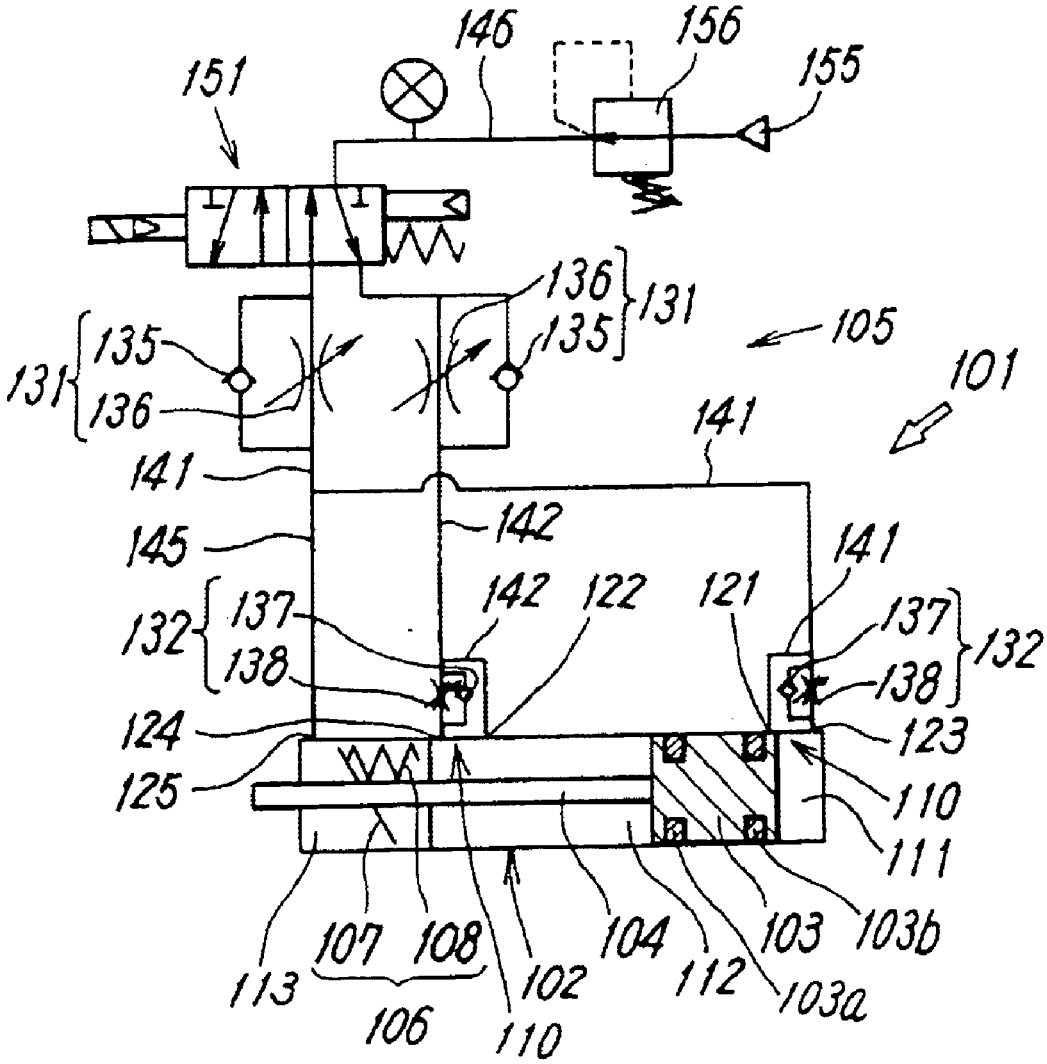
FIG. 7 PRIOR ART
FIG. 7 is a block diagram conceptually showing another conventional air cushion cylinder apparatus with a lock.

Each of the air cushion mechanism 10 of the cylinder apparatus 1 shown in FIG. 1 is similar to a conventional air cushion mechanism 110 shown in FIG. 7. Because there is no cushion member, a total length of the cylinder can be shortened.

Figure 6:
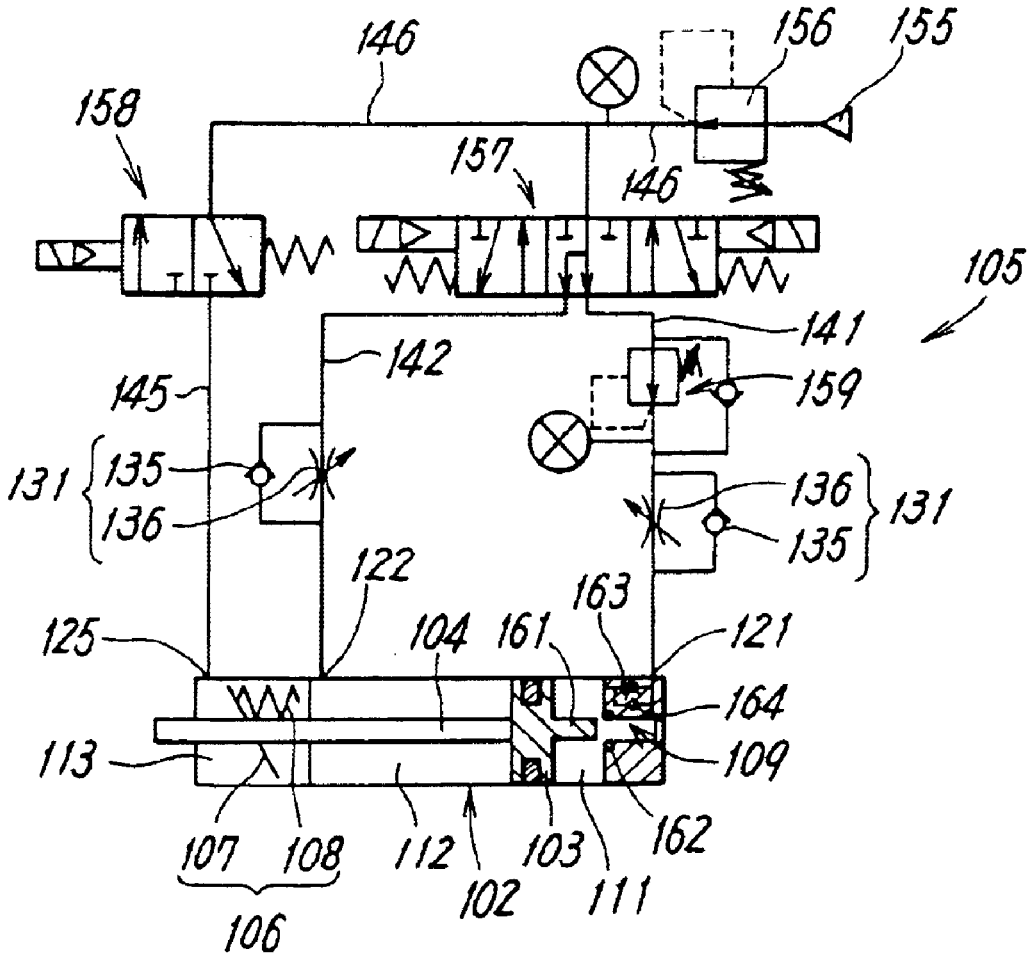
FIG. 6 PRIOR ART
FIG. 6 is a block diagram conceptually showing a conventional air cushion cylinder apparatus with a lock.

However, the air cushion mechanism used for the invention is not limited to the air cushion mechanism of the type without the cushion member as shown in FIGS. 1 and 7 but may be an air cushion mechanism having the cushion member as shown in FIG. 6.

Figure 2:
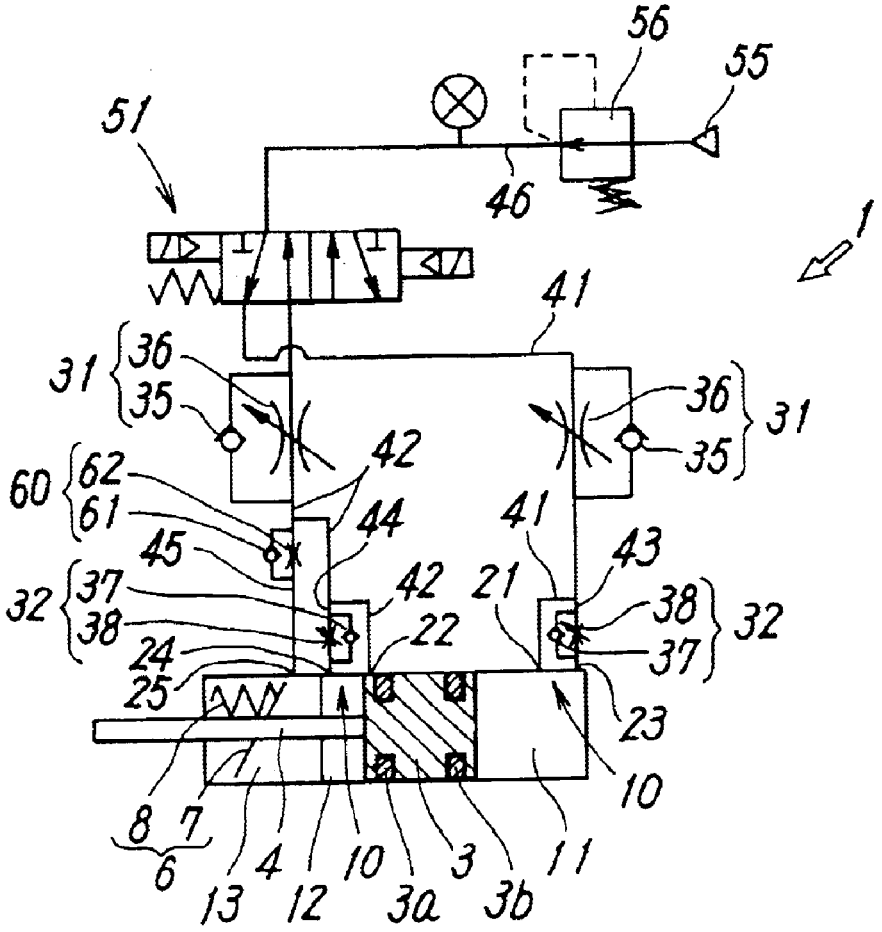
FIG. 2 is a block diagram conceptually showing another embodiment of the invention.

Although the cylinder apparatus 1 of the first embodiment shown in FIG. 1 is of a "forward lock" type in which the piston rod 4 is locked at a rear end and forward movement of the piston rod 4 is restricted, the cylinder apparatus 1 may be of a "rearward lock" type in which the piston rod 4 is locked at a forward end and rearward movement of the piston rod 4 is restricted like in the second embodiment shown in FIG. 2.

In other words, in the cylinder apparatus 1 of the first embodiment, movement of the piston rod 4 in such a direction that the lock member 7 is inclined is locked and the third port 25 is connected to the first port 21 through the third pipe 45 as shown in FIG. 1. On the other hand, in a cylinder apparatus 1 of the second embodiment, in order to lock rearward movement of the piston rod 4, a lock ring 7 is inclined in an opposite direction to the forward lock type and a third port 25 is connected to a second port 22 through a third pipe 45 as shown in FIG. 2.

Because other structures of the cylinder apparatus 1 of the second embodiment are similar to those of the first embodiment, components similar to those of the first embodiment are provided with similar reference numerals to those of the first embodiment to omit descriptions of the components.

Although air cushion mechanisms without a cushion member are used in the cylinder apparatus shown in FIG. 2, air cushion mechanisms of a cushion member type as shown in FIG. 6 can be used as a matter of course.

Figure 3:
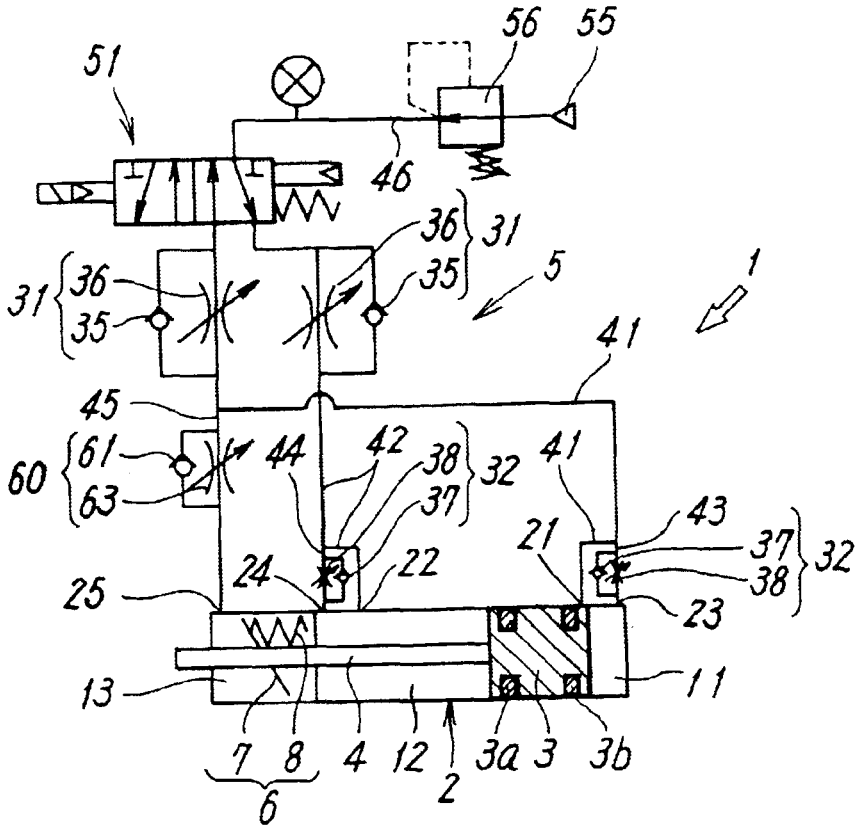
FIG. 3 is a block diagram conceptually showing yet another embodiment of the invention.

FIG. 3 conceptually shows a third embodiment of the invention. A cylinder apparatus 1 of the third embodiment is different from the cylinder apparatus 1 of the first embodiment in that a throttle valve 63 of a speed controller 60 connected in a third pipe 45 is a variable throttle valve. Because other structures of the third embodiment are similar to those of the first embodiment, components similar to those of the first embodiment are provided with similar reference numerals to those of the first embodiment to omit descriptions of the components.

Figure 4:
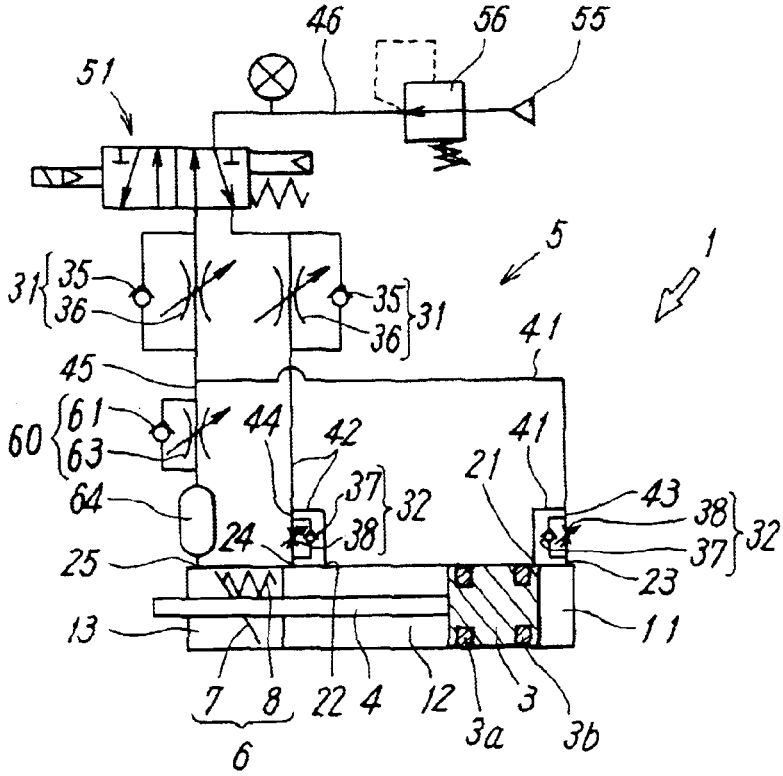
FIG. 4 is a block diagram conceptually showing yet another embodiment of the invention.

FIG. 4 conceptually shows a fourth embodiment of the invention. A cylinder apparatus 1 of the fourth embodiment is different from the cylinder apparatus 1 of the third embodiment in that a buffer tank 64 for adjusting a variation in pressure in the third pressure chamber is connected between a speed controller 60 in a third pipe 45 and a third port. The buffer tank 64 is connected in series in the third pipe 45.

Figure 5:
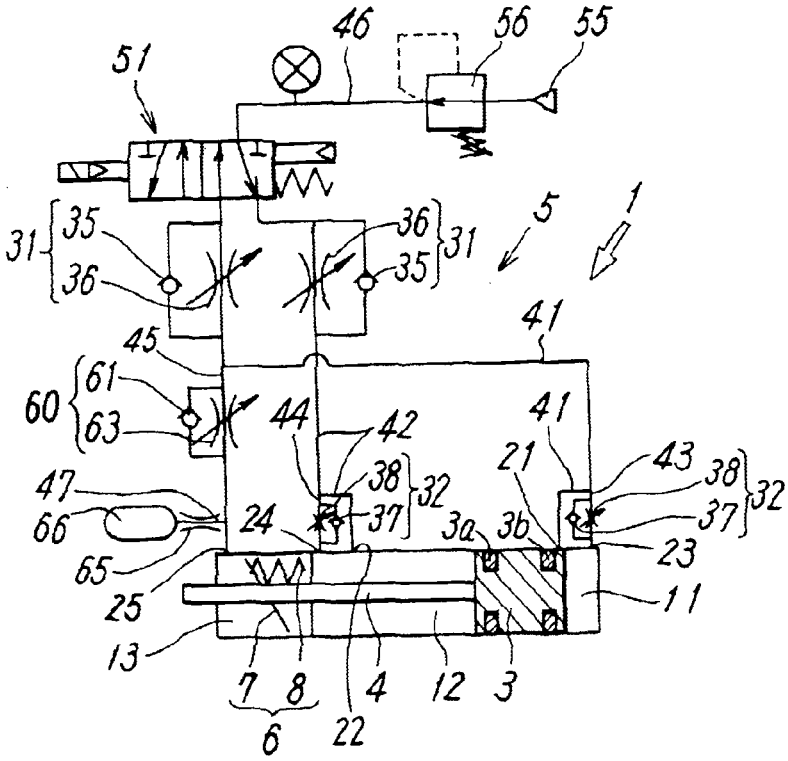
FIG. 5 is a block diagram conceptually showing yet another embodiment of the invention.

FIG. 5 conceptually shows a fifth embodiment of the invention. A cylinder apparatus 1 of the fifth embodiment is different from the cylinder apparatus 1 of the fourth embodiment in that a buffer tank 66 is connected to a fourth pipe 47 branching from the third pipe 45 through a throttle valve 65. Although a variable throttle valve is shown as the throttle valve 65 in the embodiment, a fixed throttle valve may be employed.

Because other structures of the cylinder apparatus 1 of the forth and fifth embodiments are substantially similar to those of the third embodiment, components similar to those of the third embodiment are provided with similar reference numerals to those of the third embodiment to omit descriptions of the components.

According to the third to fifth embodiments, a pressure reduction of the third pressure chamber 13 can be adjusted by the variable throttle valve 63, buffer tanks 64, 66, and the like. As a result, a time point at which the lock mechanism 6 is actuated can be adjusted and operation of the lock mechanism can be stabilized in connection with the cushion mechanisms.

Although the third to fifth embodiments are the cylinder apparatus of the forward lock type similar to that shown in FIG. 1, they may be the cylinder apparatuses of the rearward lock type similar to that shown in FIG. 2.

Although the check valve 61, the throttle valve 62, 63, 65, the buffer tank 64, 66, the pipe 47, and the like in each of the first to fifth embodiments may be connected in an outside pipe connected to the cylinder 2, one or more (or all) of them may be mounted in a body of the cylinder 2.

According to the air cushion cylinder apparatus with the lock of the invention described above in detail, there is provided the air cushion cylinder apparatus with the lock and in which stick slip and vibration do not occur and lock ring and piston rod mounted in the apparatus are not worn out in spite of a simple pneumatic circuit with the small number of parts.

What is claimed is:

1. An air cushion cylinder apparatus with a lock, the apparatus comprising a cylinder and a pneumatic circuit for supplying compressed air to the cylinder, wherein the cylinder includes a piston, a piston rod, first and second pressure chambers on opposite sides of the piston, first and second ports for supplying compressed air to the pressure chambers, an air cushion mechanism for restricting a flow rate of exhaust discharged from the respective pressure chambers to thereby stop the piston at stroke ends in a cushioned manner, and a lock mechanism for locking the piston rod at a stop position, the lock mechanism has a lock member for operating by an action of air pressure, a third pressure chamber for causing air pressure to act on the lock member, and a third port for supplying compressed air to the third pressure chamber and is formed such that the lock member unlocks the piston rod when compressed air is supplied into the third pressure chamber from the third port and that the lock member locks the piston rod when compressed air in the third pressure chamber is discharged from the third port, the pneumatic circuit includes a solenoid valve for opening and closing a flow path connecting the cylinder and a compressed air source, speed controllers each formed by connecting a check valve and a throttle valve in parallel are respectively connected in first and second pipes connecting the solenoid valve and the first and second ports, and a speed controller formed by connecting a check valve and a throttle valve in parallel is connected in a third pipe connecting the third port and the first pipe or the second pipe.

2. A cylinder apparatus according to claim 1, wherein the lock member is in a ring shape, disposed to be displaced between an inclined position for locking the piston rod and a non-inclined position for unlocking the piston rod while being fitted over the piston rod in the third pressure chamber, and pressed in an inclined direction by a lock spring.

3. A cylinder apparatus according to claim 1, wherein the throttle valve in the third pipe is a fixed throttle valve or a variable throttle valve.

4. A cylinder apparatus according to claim 1, wherein a buffer tank for adjusting a pressure variation in the third pressure chamber is provided at a position between the speed controller and the third port in the third pipe.

5. A cylinder apparatus according to claim 4, wherein the buffer tank is connected in series in the third pipe.

6. A cylinder apparatus according to claim 4, wherein the buffer tank is connected to a fourth pipe branching from the third pipe through a throttle valve.

7. A cylinder apparatus according to claim 1, wherein one or more of the check valves, the throttle valves, and the buffer tank are mounted in the cylinder.

8. An air cushion cylinder apparatus with a lock, the apparatus comprising a cylinder and a pneumatic circuit for supplying compressed air to the cylinder, wherein the cylinder includes a piston, a piston rod, first and second pressure chambers on opposite sides of the piston, first and second ports for supplying compressed air to the pressure chambers, an air cushion mechanism for restricting a flow rate of exhaust discharged from the respective pressure chambers to thereby stop the piston at stroke ends in a cushioned manner, and a lock mechanism for locking the piston rod at a stop position, the lock mechanism has a ring-shaped lock member fitted over the piston rod to be displaced between an inclined position for locking the piston rod and a non-inclined position for unlocking the piston rod, a lock spring for pressing the lock member in an inclined direction, a third pressure chamber for causing air pressure to act on the lock member to displace the lock member to the non-inclined position, and a third port for supplying compressed air to the third pressure chamber, the pneumatic circuit includes a solenoid valve for opening and closing a flow path connecting the cylinder and a compressed air source, speed controllers each formed by connecting a check valve and a throttle valve in parallel are respectively connected in first and second pipes connecting the solenoid valve and the first and second ports, a speed controller formed by connecting a check valve and a throttle valve in parallel is connected in a third pipe connecting the third port and the first pipe or the second pipe, and a buffer tank for adjusting a pressure variation in the third pressure chamber is connected at a position between the speed controller and the third port in the third pipe.

9. A cylinder apparatus according to claim 8, wherein the throttle valve in the third pipe is a fixed throttle valve or a variable throttle valve.

10. A cylinder apparatus according to claim 8, wherein the buffer tank is connected in series in the third pipe.

11. A cylinder apparatus according to claim 8, wherein the buffer tank is connected to a fourth pipe branching from the third pipe through a throttle valve.

* * * * *